United States Patent [19]

Imagi et al.

[11] 4,095,779

[45] Jun. 20, 1978

[54] APPARATUS FOR STACKING A CONTINUOUS PRINTED PAPER BEING FOLDED

[75] Inventors: Tsutomu Imagi, Kakogawa; Toshiharu Fudatsuji, Zama; Yasuhiko Torigoe, Akashi, all of Japan

[73] Assignee: Fujitsu Limited, Kawasaki, Japan

[21] Appl. No.: 707,114

[22] Filed: Jul. 20, 1976

[30] Foreign Application Priority Data

Aug. 1, 1975 Japan ..... 50-94605

[51] Int. Cl.[2] ..... B65H 45/00

[52] U.S. Cl. ..... 270/61 F; 270/30; 270/79

[58] Field of Search ..... 270/30–31, 270/61 F, 73, 79

[56] References Cited

U.S. PATENT DOCUMENTS

| | | | |
|---|---|---|---|
| 2,359,417 | 10/1944 | Hand | 270/73 |
| 3,640,521 | 2/1972 | Hutley | 270/61 F |
| 3,807,724 | 4/1974 | Bartz | 270/61 F |

FOREIGN PATENT DOCUMENTS

| | | | |
|---|---|---|---|
| 160,269 | 3/1941 | Germany | 270/79 |

*Primary Examiner*—Edgar S. Burr
*Assistant Examiner*—A. Heinz
*Attorney, Agent, or Firm*—Staas & Halsey

[57] ABSTRACT

In an apparatus for stacking a continuous printed paper delivered from an information processing system, such as a line-printer or the like, for paper stacking apparatus comprises a paper guide means for conveying a printed paper and a paper accumulation means which includes a center base plate and two accumulation plates disposed at both sides thereof, on which said printed paper is orderly stacked in its folded fashion along its pleats. In accordance with the increasing height of the stacked paper, the paper accumulation means descends and also tilting of said accumulation plates varies, which together help to maintain the uppermost surface of the stacked paper in a flat condition. Thus, the desirable stacking of paper is achieved on the accumulation means.

6 Claims, 9 Drawing Figures

1
21
23a
23b
22a
22b
24
26
34
33
28a
25
28b
30
29a
27a
27b
29b
40
132a
132b
31a
31b
32a
32b
34
228a
228b
232b
232a

APPARATUS FOR STACKING A CONTINUOUS PRINTED PAPER BEING FOLDED

BRIEF DESCRIPTION OF THE INVENTION

The present invention relates to an apparatus for stacking a printed paper with pleats. More particularly, the invention relates to an improved apparatus for stacking a continuous printed paper delivered from an information processing system, such as a line-printer or the like, and supplied into a stacking apparatus.

Such paper to be supplied into the stacking apparatus has been given a plurality of equally spaced folded lines by means of a creasing machine or the like. During the time the stacking operation of the paper is being carried out, the swelling tendency along the edges of said folded paper upwardly from its normal lever, where said paper is to be folded along its folded line and stacked on an accumulation means of the stacking apparatus, are controlled by selecting the tilt of the accumulation plates of the paper accumulation means properly, so that the uppermost surface of the stacked paper is constantly maintained in a flat condition.

BRIEF DESCRIPTION OF THE PRIOR ART

Along with a recent use of a high-speed line-printer, the requirement for the automatic stacking apparatus of the printed paper has greatly increased. There have been several apparatuses designed to meet such a requirement. Two typical types of the above apparatus are described as follows.

One type of apparatus depends on the oscillation of a delivering mechanical element in such a manner that said element oscillates synchronistically with the distance of the folded lines on the paper, so that both of the folding and the stacking operations are being carried out simultaneously.

The other type of apparatus does not utilize the above-mentioned synchronizing movement but depends on the inherent tendency of the paper to be folded.

From the point of view of folding, we may say that the former apparatus provides a type of more positive and steadier operation, but owing to the complicated mechanism and operation, the manufacturing cost of said apparatus becomes quite high. Contrary to the above, the latter apparatus utilizes several kinds of air flows and mechanical oscillating motions, for instantaneously recovering the creasing of said paper. When comparing both said operations, the latter has a negative type of operation, but owing to the simplicity of its mechanism, the manufacturing cost of the latter is cheaper.

In a case of any of the above-mentioned conventional apparatuses, common and inevitable necessities are as follows: firstly, it is necessary to maintain a constant distance between the terminal end of the paper guide means and the uppermost surface of the stacked paper on the accumulation means, secondly, it is also necessary to prevent the edges of the folded paper from being swelled upwardly from its level, so as to maintain the uppermost surface of the stacked paper in a flat condition. Thus the uniform and regular stacking of the paper is realized on the paper accumulation means.

OBJECTS OF THE INVENTION

Accordingly, it is an object of the present invention to provide an improved apparatus for stacking a paper, which is easy for maintaining a constant distance between a terminal end of a paper guide means and the uppermost surface of the stacked paper on a paper accumulation means.

It is an another object of the present invention to provide an improved apparatus for folding and stacking a paper, in which apparatus the swelling of the edges of the folded and stacked paper is completely eliminated by varying the tilt of the accumulation plates provided on the paper accumulation means, so that the uppermost surface of the stacked paper is always maintained in a flat condition.

To attain the above-mentioned former object, some of the conventional apparatuses are using a preferably adjusted coil spring or a control device for a drive motor. To attain latter object, the other conventional apparatuses use several kinds of pressing devices for pressing the swelled edges of the paper downwardly.

Among the above-mentioned apparatuses of the prior art, the latter has an excellent effect in pressing down on the edges of the folded paper; however, many accessories, such as exclusive motors, pulleys and belts, are needed. Furthermore, sometimes there are other disadvantages and drawbacks, e.g., the folded edges are scratched and/or the printed surfaces of the paper are soiled from the movement of the pressing devices. When the processed paper is thin, such drawbacks are enhanced. Sometimes, when the pressing device, e.g., the conveyor belt, is being used, there may be a danger wherein the operator's finger may be injured by such a conveyor belt. A further drawback resides in this type of an apparatus in that, when the conveyor belt is to be operated by an operator, it is necessary to remove or to open the conveyor belt for performing the operation, because of the complicated construction of the apparatus. When the stacking operation is being carried out by the apparatus of the prior art, there is a further drawback on the observation of the stacked condition, because it is difficult to observe the stacking paper from the outside of the apparatus. Because the above-mentioned problems are caused by the existence of the conveyor belt or the like, it is preferable that the apparatus does not utilize them.

Thus, the most principal object of the present invention is to provide an improved apparatus for folding and stacking a printed paper, wherein the swelling tendency at both edges of the folded paper being stacked on the paper accumulation means is securely controlled without utilizing the above-mentioned pressing device, so as to maintain the uppermost surface of the stacked paper in a flat condition.

This object is achieved by means of an apparatus for folding and stacking a printed paper, in which said paper is folded after passing through a terminal end of a paper guide means and then stacked onto a paper accumulation means, said paper accumulation means is caused to descend according to the height of the stacked paper on the accumulation means so as to maintain an approximately constant distance between the terminal end of the paper guide means and the uppermost surface of the stacked paper on the paper accumulation means, which apparatus according to the present invention is characterized in that said paper accumulation means is provided with two accumulation plates, which support both edge portions of the stacked paper thereon and which are pivotably inclined, whereby the angle of said accumulation plates is being controlled in such a way that the wider the distance between the terminal end of the paper guide means and the paper accumulation means, the greater the downward inclination of the accumulation plates.

BRIEF EXPLANATION OF THE DRAWINGS

A preferred embodiment of the invention will now be described in detail with reference to the accompanying drawings, wherein the same reference numerals are used to designate similar parts throughout the several views, in which:

FIG. 1 through FIG. 5 show several schematic cross-sectional views of the paper stacking apparatuses of the prior arts; wherein FIG. 1 is a cross-sectional view illustrating a basic concept of the conventional apparatus;

FIG. 2 is a cross-sectional view of the conveyor belts utilized for the conventional apparatus, which are downwardly inclined in a diverging direction;

FIG. 3 is a cross-sectional view of the conveyor belts utilized for the conventional apparatus, which belts are disposed vertically and in parallel;

FIG. 4 is a cross-sectional view of two wing wheels utilized for the conventional apparatus;

FIG. 5 is a cross-sectional view of two blowers utilized for the conventional apparatus;

DETAILED DESCRIPTION OF THE INVENTION

For the sake of understanding the present invention better, before entering into the illustration of the present invention in detail, the conventional stacking apparatus for printed paper is hereinafter illustrated with reference to the attached drawings FIGS. 1 through FIG. 5.

Figure 1:
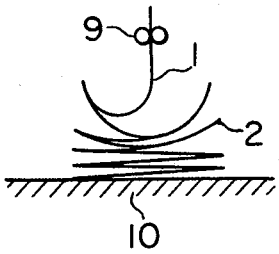
Fig. 1 PRIOR ART

Referring to the attached drawings, FIG. 1 shows a basic concept of the paper stacking apparatus of the prior art. The most typical paper stacking apparatus comprises a pair of feed rollers 9 utilized to effect the folding operation of the paper 1 and a paper accumulation table 10, which is adapted for descents according to the increasing height of the stacked paper 1 thereon. The problem encountered in the above-mentioned conventional apparatus is that, when the stacking operation of the paper 1 is being carried out, both edges 2 of the stacked paper 1 show a swelled arrangement. This means that both sides of the stacked paper 1 rise up higher when compared to the midportion thereof. Therefore, if the paper 1 is continuously stacked onto said surface and if the height of the paper at that surface becomes too great, then there is a good chance for the stacked paper to become disarranged, or out of its regular stacked order and, moreover, cannot attain the uniform stacking of the folded paper. To avoid this problem, several kinds of paper stacking apparatuses have been designed.

Figure 2:
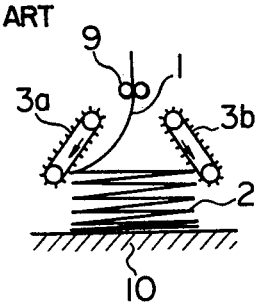
Fig. 2 PRIOR ART

In FIG. 2 showing the second example of the prior art, two conveyor belts (*3a, 3b*) are arranged at both sides of the stacked paper in such a manner that the belts are inclined diverging downwardly, so that said belts act upon the both sides of edges 2 on the uppermost surface of the stacked paper. The conveyor belts have a plurality of projections projected outwardly therefrom (such conveyor belts hereinafter referred to as the create conveyor belts), and are so arranged that they are constantly in contact with said edges 2 such that the swelled edges can be pressed down by the create conveyor belts.

Figure 3:
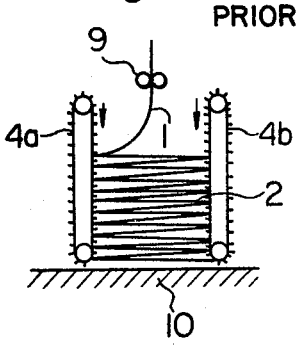
Fig. 3 PRIOR ART

In FIG. 3 showing the third example of the prior art, two create conveyor belts (*4a, 4b*) are arranged vertically and in parallel to each other. When the create conveyor belts are running, the projections of the belts come into contact with each of the edges progressively, so that the each of the edges 2 is pressed downwardly by the friction occuring between the projections of the belts and the edges 2 of the paper 1.

Figure 4:
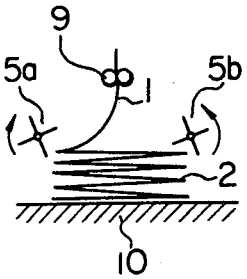
Fig. 4 PRIOR ART

In FIG. 4 showing the fourth example of the prior art, both edges 2 on the uppermost surface of the stacked paper 1 are pressed downwardly by means of the wing wheels (*5a, 5b*), which are disposed above both sides of the said edges.

Figure 5:
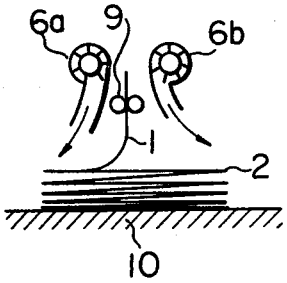
Fig. 5 PRIOR ART

In FIG. 5 showing the fifth example of the prior art, two blowers (*6a, 6b*) for blowing air toward both said edges are utilized. Since the directions of the air flows are inclined diverging downwardly, they blow both edges on the uppermost surface of the stacked paper 1 downwardly. Owing to such air flows, the pressing down action against both edges of said paper may be accomplished.

All of foregoing apparatuses are adapted for facilitating the folding and stacking operation; however the pressing down effect on the stack paper is not too satisfactory.

Contrary to the above, the apparatus according to the present invention includes a controlling mechanism (not shown), which comprises a coil spring or a control device for a drive motor, so as to carry out the stacking of paper on the paper accumulation means by displacing the paper accumulation means along the vertical direction thereof. In this way, the distance between the terminal end of the paper guide means and the uppermost surface of the stacked paper on the paper accumulation means is maintained constant.

Furthermore, the apparatus according to the present invention is designed in such a way that, in accordance with the descent of the paper accumulation means, the inclination of both accumulation plates, on which both sides of the stacked paper are held, is increased to the horizontal. As a result, there is no swelling tendency of the edges on the uppermost surface of the stacked paper and said surface will always be maintained in a flat condition.

A preferred embodiment of the invention will now be described in detail with reference to the accompanying drawings.

Figure 6:
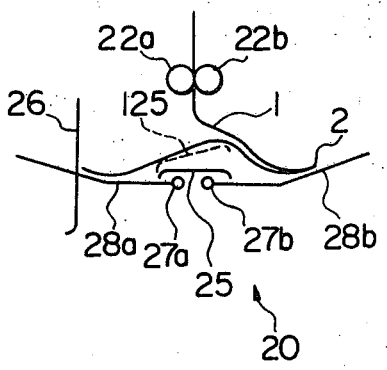
FIG. 6 is a schematic cross-sectional view showing the main constructive parts of the apparatus according to the present invention, in which the placing of the fresh paper to be laid onto a paper accumulation means has commenced.
Figure 7:
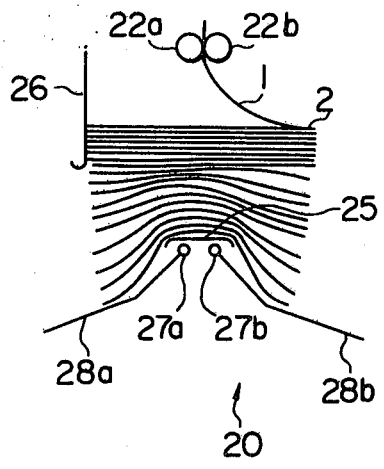
FIG. 7 is a schematic cross-sectional view showing the main parts of the apparatus in FIG. 6, in which the paper is folded and stacked onto the paper accumulation means.

FIGS. 6 and 7 show the main parts of an embodiment according to the present invention. FIG. 6 is a view of the paper folding and stacking apparatus at its starting position, and FIG. 7 is a view of the same when some stacking has already been accomplished. With regard to FIGS. 6 and 7, many elements of the apparatus are not shown in order to reveal important details.

As shown in FIGS. 6 and 7, the printed paper 1 delivered from a line-printer (not shown) is supplied to an accumulation means 20 after passing through a pair of feed rollers 22a, 22b so as to achieve a stacking of a folded paper 1 in such a manner that the paper 1 is folded along the folded or creased lines which were premade in a creasing machine (not shown).

Referring to FIG. 6, in order to cause the leading edge 3 of the supplied paper 1 to abut against a stop member 26, a center base plate 25 is inclined downwardly toward said stop member 26, so that the neighboring edge of said center base plate 25 adjacent to said stop member 26 is lower than the other edge as shown by the phantom line 125 in FIG. 6. In turn, when the leading edge 3 of the paper abuts against the stop member 26, the center base plate 25 swings back to its horizontal position as shown by the solid line 25, in response to a signal from a detector (not shown). Since the feed rollers 22a, 22b are rotated continuously, the folding and stacking operation of the paper 1 on the accumulation means 20 is carried out smoothly.

Figure 8:
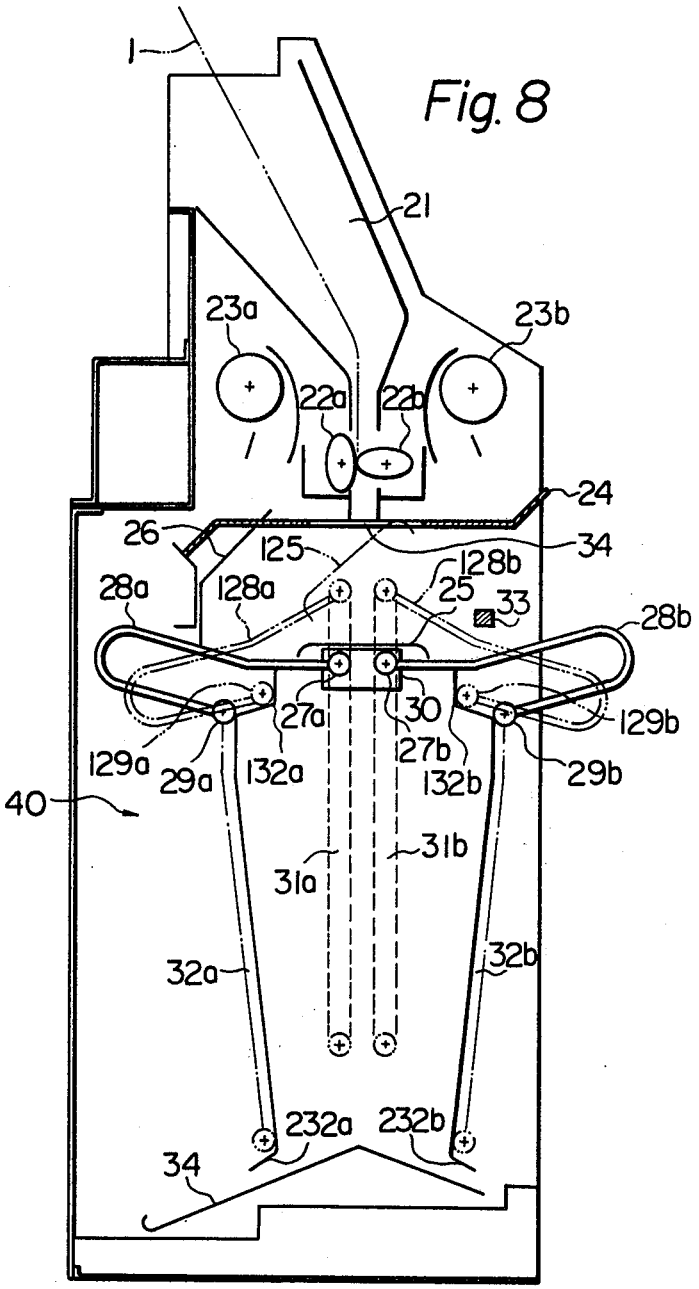
FIG. 8 is a cross-sectional detailed view of the apparatus according to the present invention, in which the paper accumulation means is located at the starting-up position.

The accumulation means 20 includes the above-mentioned center base plate 25 and two accumulation plates (28a, 28b) provided under the center base plate 25. The outer portions of said plates (28a, 28b) are projected upwardly in an obtuse angle while the inside terminal ends of said plates are pivotally supported on the pins (27a, 27b) which are disposed under the center base plate 25. Each of the pins (27a, 27b) is adapted for sliding along two rails (31a, 31b) which rails are disposed vertically and in parallel to each other (FIG. 8). As the pins (27a, 27b) descend along the vertical rails 31a, 31b in accordance with an increase in the height of the stacked paper 1 on the accumulation means 20, the accumulation plates (28a, 28b) are swung downwardly around the pins (27a, 27b) as shown in FIG. 7. According to the increased stacking of the paper on the accumulation table 20, the swelling tendency of the edges of the stacked paper becomes greater. However, owing to the position of the angle in the accumulation plates (12a, 12b), said possible swelled height of the paper is compensated by the inclination of the plates. Therefore, the upper surface of the paper to be stacked is always maintained in a flat condition, so that the succeeding paper coming from the line-printer is continuously stacked in a uniform condition on the accumulation means 20.

The operation of the paper stacking apparatus of the present invention is hereinafter explained in more detail.

FIG. 8 is a constructive illustration of the apparatus embodying the novel concept of the present invention. In the drawing, the numeral 21 is a paper guide means, in which a printed paper (for example, printed by a line-printer or the like) passes. At the terminal end of said paper guide means 21 is provided a pair of feed rollers (22a, 22b), which are formed in the shape of an oval or an ellipse. The outer surface of the rollers (22a, 22b) are always in contact with each other and are rotated by means of a drive mechanism (not shown). On the other hand, on the sides to the above right and left of the pair of rollers (22a, 22b) are disposed two blowers (23a, 23b), which blow air flow downwardly against the outer peripheries of the uppermost surface of the stacked paper so as to assist the folding operation. By means of the vibrating motion of the rollers (22a, 22b), caused by the rolling contact between the elliptical rollers, the folding operation is performed effectively.

Figure 9:
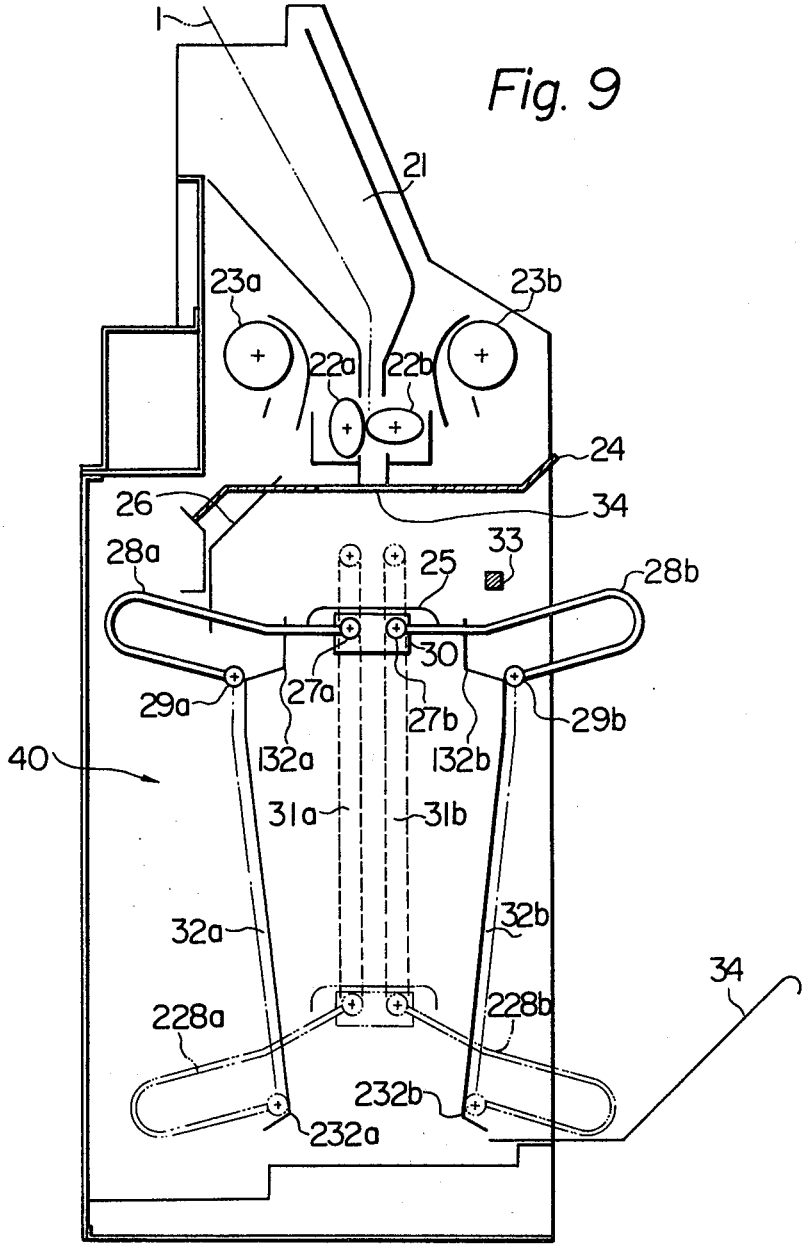
FIG. 9 is a cross-sectional detailed view of the apparatus according to the present invention, in which the paper accumulation means is located at the finishing position.

Then the paper is delivered continuously onto an accumulation apparatus 40 after passing through an opening 34 provided in a separate plate 24, which is disposed beneath said rollers (22a, 22b). A paper accumulation means 40 comprises a center base plate 25 movably mounted on a support table 30 and two U-shaped accumulation plates or combs (28a, 28b). Each of said accumulation plates (28a, 28b) consists of one long side, which is depressed downwardly, a curved portion, and another short side. The end of said one long side is pivotably mounted to a hinge pin (27a, 27b), which is rotatably fixed to the support table 30. Also on an extreme end of the other short side, a guide roller (29a, 29b) is pivotably mounted. Said guide rollers (29a, 29b) are so arranged that they can slide downwardly along two guide rails (32a, 32b), which are disposed vertically and can converge downwardly. All of the foregoing parts of the accumulation plates (28a, 28b) and of the guide rails (32a, 32b) are symmetrically arranged. Said guide rails have steps (132a, 132b) at their upper portions and have other steps (232a, 232b) at their lower portions as shown in FIGS. 8 and 9, respectively.

As the stacking operation is starting up, the accumulation plates take position at the upper portion of guide rails (32a, 32b), as shown by phantom lines (128a, 128b), owing to the fact that said rollers (29a, 29b) are held on said upper steps of the guide rails (32a, 32b), as shown by phantom lines (129a, 129b); the positions of the accumulation plates (28a, 28b) are inclined while diverging downwardly as shown by phantom lines (128a, 128b). At the same time, in accordance with the above-mentioned positions of the accumulation plates, a center base plate 25 is downwardly inclined toward a stop member 26, disposed beneath the separate plate 24. Said position of the center base plate 25 is shown by the phantom line 125. In this way, the leading edge of the supplied paper 1 is abutted against the stop member 26, i.e., the center base plate functions as an introducer for said paper.

In turn, when the leading edge of the paper 1 abuts against the stop member 26, the accumulation plates move to the position as shown by block lines (28a, 28b), and the center base 25 plate swings back to its horizontal position as shown by the solid line 25.

The above-mentioned movement of the accumulation plates (28a, 28b ) and the center base plate 25 are achieved by the downward movement of the support table 30. Further, the movement of the support table is carried out, e.g., by means of a pair of vertically traversing endless belts (31a, 31b) being disposed between two pairs of rollers rotatably provided in the apparatus. The traverse motion of the above-mentioned belts (31a, 31b) may be achieved by a drive motor (not shown) with a control means which consists of a well-known controlling device.

When the accumulation plates take the position as shown by the solid lines (28a, 28b), the guide rollers are positioned at the shoulder portion of the guide rails (32a, 32b) as shown by the solid lines (29a, 29b). The height of the uppermost surface of the stacked paper is detected by means of a photoelectric switch 33 provided on the apparatus. If the level of the stacked paper is greater than the standard level, the support table 30, which carries the accumulation means 40, commences to descend by means of the drive motor along the belts (31a, 31b), in response to a signal from said photoelectric switch 33. As the same time the guide rollers (29a, 29b) will descend along the guide rails (32a, 32b). Since the guide rails (32a, 32b) are converging toward each other at their lowest ends, as the accumulation plates (28*a*, 28*b*) descend, the angle of inclination to the horizontal ground level increases; thus, said inclination of the accumulation plates becomes maximum at the lowest ends of the guide rails shown by phantom lines (228*a*, 228*b*) in FIG. 9. This produces the effect of the flat condition on the uppermost surface of the stacked paper, thus making it possible to take out the uniformly stacked paper through a take out plate 34, which is provided on the lower portion of the apparatus.

Although the descending of the paper accumulation means is employed in the illustrated embodiment by the driving of the motor which is actuated by means of a photoelectric switch, and the inclination of the accumulation plates depends on the guide rails, it will be apparent that any equivalent control means may be employed for this purpose. Also the intensity and the direction of the air flow produced by the blowers (23*a*, 23*b*) are chosen so that the most effective introducing of the leading edge of the paper and folding of the same may be achieved upon the stacked paper.

What is claimed is:

1. An apparatus for folding and stacking a printed paper, comprising:

paper guide means for guiding said printed paper and having a terminal end through which said guided paper passes;

paper accumulation means for receiving said guided paper passing through said terminal end, and having a center base plate for accumulating said received paper, said paper accumulation means further including means for lowering said center base plate according to the height of the stacked paper thereon, so as to maintain an approximately constant distance between the terminal end of the paper guide means and the uppermost surface of the stacked paper on the paper accumulation means, said paper accumulation means further including two accumulation plates disposed on opposite sides of said center base plate and having a variable angular orientation with respect to said center base plate for supporting respective edge portions of the stacked paper thereon, said accumulation means further including means for pivotably swinging said two accumulation plates as said center base plate is lowered so as to vary the angular orientation of said accumulation plates in a downward direction with respect to said center base plate in such a way that the larger the distance between the terminal end of the paper guide means and the paper accumulation means, the greater the downward angular orientation of the accumulation plates, wherein said accumulation plates comprise two symmetrical plates, each one end of said plates being pivotably connected to a support table which is vertically movable in accordance with the distance between the terminal end of the paper guide means and the paper accumulation means, said swinging means comprising a pair of guide rails, each having an upper end and a lower end, said pair of guide rails converging at said lower end thereof, each other end of said plates being slidably in contact with the guide rails so as to cause said accumulator plates to swing as said center base plate is lowered.

2. An apparatus according to claim 1, wherein said means for lowering said center base plate comprises a pair of endless guide belts arranged in a vertical direction and carrying said center base plate, and drive means connected to said endless guide belts for driving same so as to lower said center base plate.

3. An apparatus according to claim 2, including photodetector means for detecting when a predetermined height of paper has been stacked in said accumulator means and operatively associated with said drive means for activating same to cause lowering of said center base plate and said pair of accumulator plates pivotably connected thereto.

4. An apparatus for folding and stacking a pre-pleated paper provided thereto, said apparatus comprising:

guide means for guiding said paper into said apparatus, and having a terminal end through which said guided paper exits; and paper accumulator means for accumulating and stacking said pre-pleated paper, said paper accumulator means including a center base plate, a pair of accumulator plates each disposed on a respective side of said pair of accumulator plates and means pivotably connecting said pair of accumulator plates to said center base plate so as to have a variable angular orientation with respect to said center base plate, means for lowering said center base plate and said pair of accumulator plates pivotably connected thereto as paper is accumulated in said accumulator means, and means responsive to the lowering of said center base plate and said pair of accumulator plates pivotably connected thereto for pivotably swinging each respective one of said pair of accumulator plates so as to vary in a downward direction said variable angular orientation of each respective accumulator plate with respect to said center base plate, whereby each respective accumulator plate becomes increasingly downwardly inclined from said center base plate as said center base plate is lowered, wherein each respective accumulator plate has a first end pivotably connected to said center base plate, and a second end, said swinging means comprising a pair of guide rails extending in a vertical direction and in a converging manner, and a pair of respective rollers, each slidably connecting said second end of each respective accumulator plate to a respective one of said pair of guide rails.

5. An apparatus according to claim 4, wherein said means for lowering said center base plate and said pair of accumulator plates pivotably connected thereto comprises a pair of endless guide belts arranged in a vertical direction and carrying said center base plate, and drive means connected to said endless guide belts for driving same so as to lower said center base plate.

6. An apparatus according to claim 5, including photodetector means for detecting when a predetermined height of paper has been stacked in said accumulator means and operatively associated with said drive means for activating same to cause lowering of said center base plate and said pair of accumulator plates pivotably connected thereto.

* * * * *

UNITED STATES PATENT AND TRADEMARK OFFICE

CERTIFICATE OF CORRECTION

PATENT NO. : 4,095,779

DATED : June 20, 1978

INVENTOR(S) : Tsutomu Imagi et al

It is certified that error appears in the above-identified patent and that said Letters Patent are hereby corrected as shown below:

Column 4, line 38, "stack" should be --stacked--.

Signed and Sealed this

*Twelfth* Day of *December 1978*

[SEAL]

*Attest:*

RUTH C. MASON
*Attesting Officer*

DONALD W. BANNER
*Commissioner of Patents and Trademarks*